United States Patent [19]

Wahba

[11] Patent Number: 4,925,112

[45] Date of Patent: May 15, 1990

[54] FUEL INJECTION

[75] Inventor: Brent J. Wahba, Rochester, N.Y.

[73] Assignee: General Motors Corporation, Detroit, Mich.

[21] Appl. No.: 369,502

[22] Filed: Jun. 21, 1989

[51] Int. Cl.[5] ..... B05B 1/30; F02M 61/08

[52] U.S. Cl. ..... 239/585; 137/637; 137/897

[58] Field of Search ..... 239/585; 251/129.09, 251/129.1; 137/637, 897

[56] References Cited

U.S. PATENT DOCUMENTS

| | | | |
|---|---|---|---|
| 4,572,436 | 2/1986 | Stettner et al. | 239/585 |
| 4,621,660 | 11/1986 | Klocke | 251/129.09 X |
| 4,759,335 | 7/1988 | Ragg et al. | 123/531 |
| 4,844,334 | 7/1989 | Sayer et al. | 239/585 X |

*Primary Examiner*—Andres Kashnikow
*Assistant Examiner*—William Grant
*Attorney, Agent, or Firm*—C. K. Veenstra

[57] ABSTRACT

In an injector adapted to deliver a charge of fuel and air directly into the combustion chamber of a two-stroke cycle engine, a pair of solenoid coils are aligned along a common axis between an armature that serves as a fuel metering valve and an armature that operates a charge delivery valve.

1 Claim, 1 Drawing Sheet

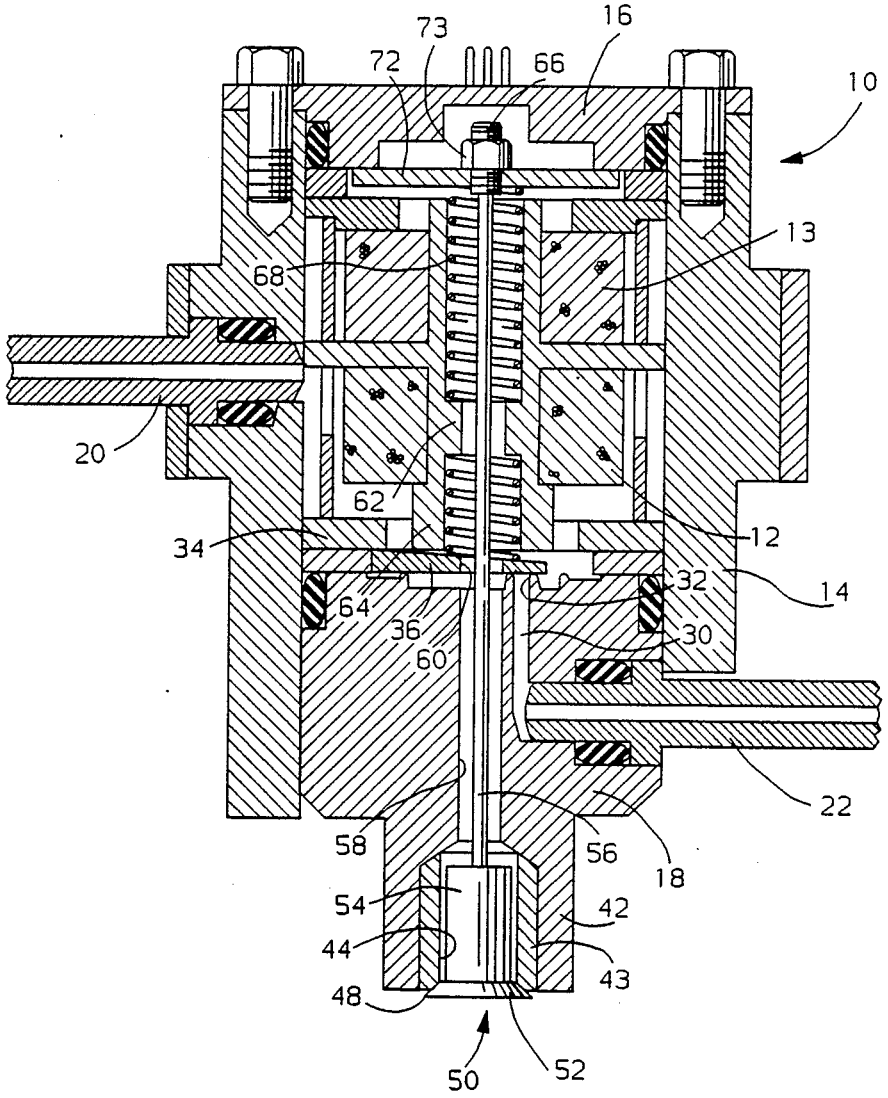
73
16
72
66
10
13
68
20
62
12
34
32
14
64
36
30
60
22
58
56
18
54
42
44
43
48
50
52

FUEL INJECTION

TECHNICAL FIELD

This invention relates to an injector adapted to deliver a charge of fuel and air directly into an engine combustion chamber.

BACKGROUND

U.S. Pat. No. 4,759,335, issued 26 July 1988 in the names of P. W. Ragg, M. L. McKay and R. S. Brooks, shows an injector that delivers a fuel-air charge directly into the combustion chamber of a two-stroke cycle engine. The injector has a valve that meters fuel into the injector where the fuel mixes with air to form a fuel-air charge, a valve that delivers the fuel-air charge into the engine, and a pair of solenoids that actuate the valves in sequence. The solenoids are physically separate, creating a large injector that requires substantial space on the engine.

SUMMARY OF THE INVENTION

This invention provides an injector having a pair of solenoids that are integrated in a single package to minimize the size of the injector.

In an injector employing this invention, a pair of solenoid coils are aligned along a common axis between one armature that serves as a fuel metering valve and another armature that operates a charge delivery valve. One coil is energized to open the fuel metering valve and meter fuel into the injector where the fuel mixes with air to form a fuel-air charge; the other coil is energized to open the charge delivery valve and deliver the fuel-air charge into the engine.

The details as well as other features and advantages of an injector employing this invention are set forth in the remainder of the specification and are shown in the accompanying drawing.

SUMMARY OF THE DRAWING

The sole figure is a schematic axial sectional view of an injector employing this invention, having a pair of coils aligned along a common axis between a lower armature that serves as a fuel metering valve and an upper armature that operates a charge delivery valve.

THE PREFERRED EMBODIMENT

Referring to the drawing, an injector 10 has a pair of solenoid coils 12 and 13 aligned along a common axis within a housing 14 between a cover 16 and a fuel body 18. An inlet fitting 20 directs air into housing 14, and an inlet fitting 22 directs fuel into body 18. A passage 30 opens from inlet fitting 22 through a valve seat 32 into housing 14.

A locator ring 34 is sandwiched between coil 12 and fuel body 18. Ring 34 positions a tapered armature valve member 36 over valve seat 32. Armature valve member 36 may have the attributes set forth in U.S. Pat. No. 4,572,436 issued 25 February 1986 in the names of E. R. Stettner, K. P. Cianfichi and D. D. Stoltman; the disclosure of that patent is incorporated here by reference.

Fuel body 18 has an extension 42 forming a nozzle body. The nozzle body includes an insert 43 with a central bore 44 surrounded by a valve seat 48.

A valve member 50 has a head 52 engaging valve seat 48 and a neck 54 extending into bore 44. An operating rod 56 extends from valve member 50 through bore 44, a mating bore 58 in fuel body 18, an opening 60 in armature valve member 36, and a bore 62 through the solenoid center pole 64, to a threaded end 66.

Another locator ring 70 is sandwiched between coil 12 and cover 16. An armature 72 is positioned by ring 70 about the threaded end 66 of rod 56 and is captured between a nut 73 and a spring 68. Spring 68 is engaged between center pole 64 and armature 72 to bias the head 52 of valve member 50 into engagement with valve seat 48.

A spring 74 is engaged between center pole 64 and armature valve member 36 to bias armature valve member 36 into engagement with valve seat 32.

In operation, solenoid coil 12 is energized to lift armature valve member 36 from seat 32 against the bias of spring 74, while spring 68 holds valve member 50 against seat 48; armature valve member 36 then meters fuel from passage 30 into housing 14 where it mixes with the air to form a fuel-air charge. Then when solenoid coil 13 is energized, armature 72 pushes rod 56 against the bias of spring 68 to displace valve member 50 from seat 48, and valve member 50 allows the fuel-air charge to pass through bores 58 and 44 and delivers the fuel-air charge into the combustion chamber of the engine (not shown).

Aligning coils 12 and 13 along a common axis, and between armature valve member 36 and armature 72, provides a compact cylindrical injector that may be readily installed on the engine. Moreover, coils 12 and 13 share a portion of their flux paths, and a lead through which current is supplied to the coils.

I claim:

1. The injector for delivering a charge of fuel and air directly into an engine combustion chamber, the injector having an air inlet, a fuel inlet, a valve seat surrounding the fuel inlet, a fuel metering armature defining a fuel metering valve member, a fuel metering valve spring biasing the fuel metering armature to engage the fuel metering valve member with the fuel inlet valve seat, a charge delivery valve seat through which fuel and air are delivered to the engine, a charge delivery valve member, an operating rod extending from the charge delivery valve member, a charge delivery valve spring biasing the operating rod to engage the charge delivery valve member with the charge delivery valve seat, a charge delivery armature, a fuel metering solenoid coil, and a charge delivery solenoid coil, the fuel metering armature being effective when the fuel metering coil is energized to displace the fuel metering valve member from the fuel inlet valve seat while the charge delivery valve spring maintains the charge delivery valve member in engagement with the nozzle body valve seat, the charge delivery armature being effective when the charge delivery coil is energized to displace the operating rod and thereby displace the charge delivery valve member from the nozzle body valve seat, and wherein the solenoid coils are aligned along a common axis and disposed between the armatures.

* * * * *